United States Patent [19]

Modes et al.

[11] Patent Number: 4,765,874

[45] Date of Patent: Aug. 23, 1988

[54] LAMINATED ELECTRODE THE USE THEREOF

[75] Inventors: Christina Modes, Darmstadt; Heinrich Meyer, Hanau; Jochen-Werner K. Burgsdorff, Bruchköbel; Ulrich Ströder, Rodenbach; Andrea Krämer, Hanau, all of Fed. Rep. of Germany

[73] Assignee: W. C. Heraeus GmbH, Hanau, Fed. Rep. of Germany

[21] Appl. No.: 944,849

[22] Filed: Dec. 22, 1986

Related U.S. Application Data

[63] Continuation of Ser. No. 733,754, May 14, 1985, abandoned.

[30] Foreign Application Priority Data

Jun. 27, 1984 [DE] Fed. Rep. of Germany ..... 3423605

[51] Int. Cl.[4] ..... C25C 1/00

[52] U.S. Cl. ..... 204/105 R; 204/129; 204/242; 204/290 R; 204/294

[58] Field of Search ..... 204/98, 128, 290 R, 204/294, 45.1, 105 R, 106, 115, 129, 242

[56] References Cited

U.S. PATENT DOCUMENTS

| | | | |
|---|---|---|---|
| 3,632,498 | 1/1972 | Beer | 204/290 F |
| 3,856,574 | 12/1974 | Amagi et al. | 204/294 |
| 4,135,995 | 1/1979 | Welch | 204/98 |
| 4,236,993 | 12/1980 | Muller et al. | 204/294 |
| 4,278,525 | 7/1981 | Gestaut | 204/290 R |
| 4,287,032 | 9/1981 | Pellegri et al. | 204/128 |
| 4,293,396 | 10/1981 | Allen et al. | 204/106 |
| 4,337,140 | 6/1982 | Solomon et al. | 204/292 |
| 4,354,950 | 10/1982 | Solomon | 204/294 |
| 4,357,262 | 11/1982 | Solomon | 204/290 R |
| 4,379,772 | 4/1983 | Solomon et al. | 204/290 R |
| 4,382,904 | 5/1983 | Gestaut et al. | 204/290 R |
| 4,414,092 | 11/1983 | Lu et al. | 204/294 |
| 4,431,567 | 2/1984 | Gestaut | 502/101 |
| 4,440,617 | 4/1984 | Solomon | 204/290 R |
| 4,457,823 | 7/1984 | LaConti et al. | 204/282 |
| 4,472,257 | 9/1984 | Sklyarov et al. | 204/290 R |
| 4,511,442 | 4/1985 | Pellegri | 204/98 |

FOREIGN PATENT DOCUMENTS

| | | |
|---|---|---|
| 0046448 | 2/1982 | European Pat. Off. . |
| 0046727 | 3/1982 | European Pat. Off. . |
| 0062951 | 10/1982 | European Pat. Off. . |
| 0087186 | 8/1983 | European Pat. Off. . |
| 0090381 | 10/1983 | European Pat. Off. . |
| 1571721 | 3/1980 | Fed. Rep. of Germany . |
| 0150764 | 9/1981 | German Democratic Rep. . |

OTHER PUBLICATIONS

Bard & Faulkner, Electrochemical Methods, 1980.
Schmidt, Angewandte Elektrochemie, 1976, 66.

*Primary Examiner*—John F. Niebling
*Assistant Examiner*—Kathryn Rubino
*Attorney, Agent, or Firm*—Felfe & Lynch

[57] ABSTRACT

Laminated electrodes and a method for their preparation are described, these electrodes being composed of electrically conductive plastic having catalytic particles, composed of a catalyst deposited on supporting particles, pressed partially into the plastic. They can be used as oxygen anodes, for example in the electrolytic recovery of metal from aqueous solutions.

20 Claims, 1 Drawing Sheet

LAMINATED ELECTRODE THE USE THEREOF

Figure 1:
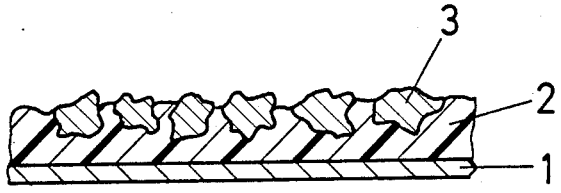

This is a continuation application of application Ser. No. 733,754 filed May 14, 1985, now abandoned.

This invention relates to a laminated electrode comprising an electrically conductive base body and catalytic particles made of a catalyst supported on particles and embedded in the base body, and to a method for producing such an electrode, and to the use thereof.

For electrolysis processes performed with the evolution of oxygen at the anode, for example for the electrolytic recovery of metals from aqueous solutions and for electrochemical reductions of organic compounds, anodes are required which have a very low oxygen overpotential.

At the present time, anodes of lead alloys containing a small amount of calcium, cobalt or silver are commonly used in the electrolytic recovery of copper and zinc. Lead anodes are also used in organic electrosynthesis. They are relatively inexpensive and can be used for several years. Disadvantages are the relatively high oxygen overpotential, which results in the corrosion of the lead leading to contamination of the electrolysis products, and the great weight of the anodes which makes them difficult to handle.

For several decades, metal electrodes coated with noble metals or noble metal oxides have been known, which offer special advantages.

Such activated electrodes with lower overpotentials can consist, as described in German Pat. No. 15 71 721, of a core of film-forming metal or valve metal (titanium, tantalum, zirconium, niobium, or an alloy of these metals) and of an electrochemically active coating of oxides of metals of the platinum group, plus, in some cases, base metal oxides. This type of electrode has enjoyed wide usage as a dimensionally stable anode in the production of chlorine.

In European Pat. No. 46,448, for the protection of the electrode substrate consisting, for example, of titanium, a layer of electrically conductive, insoluble polymer mesh between the substrate and the outer coating is proposed. The polymer mesh can contain, as the finely divided electrically conductive material, a catalyst of one or more platinum group metals, also in the form of the oxides, and it is produced in situ on the electrode substrate.

Dimensionally stable anodes of enlarged active surface suitable for the electrolytic recovery of metal from acid solutions and made of lead or lead alloy with catalytic particles partially embedded in the surface are described in European Patent Application No. 46,727. The catalytic particles, whose size is between 75 and 850 microns, consist of valve metal, such as titanium for example, and a platinum-group metal as catalyst applied onto the titanium in metallic or oxidic form by thermal decomposition. Also base-metal catalysts such as manganese oxide, can be used.

Electrodes made of lead plates and particles pressed into their surface, composed of supporting particles, such as titanium sponge, coated with plastic containing finely distributed platinum-group metal (oxide) as catalyst, are disclosed in European Patent Application No. 62,951.

The anodes described in European Patent Application No. 87,186, which develop oxygen in acid solution and have a low oxygen overpotential, consist of lead or lead alloys and, partially embedded in their surface, particles of titanium and/or titanium oxide (rutile) with ruthenium oxide and, in some cases, manganese oxide and titanium oxide applied to their surface.

The electrodes described in GDR Pat. No. 150,764 also contain metals or metal compounds having electrocatalytic properties, but they are applied to graphite. The porous graphite substrate of these electrodes contains in its pores the electrochemically active metals or metal compounds and an electrochemically inert organic substance, such as polystyrene, polyethylene, polymethylmethacrylate, polyvinyl chloride or polyester acrylate, for example.

Anodes having a catalytic surface for use in numerous electrolytic processes instead of titanium, graphite and lead anodes are disclosed in European Patent Application No. 90,381. They consist of an electrically conductive combination material of carbon or graphite and plastic, especially a thermoplastic, fluorinated polymer whose surface is provided with an electrocatalytic layer of chemically inert plastic with a catalyst consisting of noble metal or base metal (oxide) finely divided therein. The active surface of these anodes is substantially smaller than that described in European Patent Application No. 46,727, and is to be enlarged by mechanical roughening. Also, relatively large amounts of catalyst are necessary.

It is the purpose of the invention to find a laminated electrode which is corrosion-resistant and easy to handle, which is long-lasting, and which, like the one described in European Patent Application No. 46,727, will have a large active surface area. The active surface is to consist of catalytic particles composed of support particles with an electrochemically active catalyst applied to them.

The laminated electrode representing the solution of this problem is characterized in accordance with the invention by the fact that the base body comprises electrically conductive plastic.

The electrically conductive plastic has preferably a thickness of at least 2 mm and contains preferably finely divided carbon as the electrically conductive material.

The laminated electrode of the invention has the following advantages:

- Relatively light weight and ease of handling on account of the base body of electrically conductive plastic.
- The electrically conductive plastic carrying the electrical current remains electrochemically inactive and is not subject to any corrosion or dimensional changes as long as the catalyst particles are active.
- Smaller catalyst content.
- Large active surface area.
- Low oxygen overpotential, and
- Long life.

The electrically conductive plastic having an electrical resistance lower than 10,000 ohms millimeter preferably comprises a suitable plastic and finely divided carbon uniformly distributed therein, for example in the form of carbon black or graphite. Its external shape is selected according to the purpose. Plates of a thickness of at least 2 mm have proven especially useful.

Suitable plastics are especially all thermoplastics having sufficient chemical resistance. Examples are polyethylene, polypropylene, polystyrene, polymethacrylates, polyester acrylates, polyamides, polyacetals, polycarbonates, polytetrafluoroethylene, copolymers of tetrafluoroethylene such as tetrafluoroethylene-ethylene and tetrafluoroethylene-perfluoropropylene copolymer, polytrifluorochloroethylene and polyvinyl chloride.

The selection of the plastic depends on the electrolysis conditions, such as the composition of the electrolyte and the current density. In 15% sulfuric acid, at anodic current densities up to 1 kA/m$^2$, polyethylene, polypropylene and polytetrafluoroethylene have performed well. Preferably, the electrically conductive plastic then consists of one of these polymers and 5 to 80% of graphite by weight, with a particle size under 150 microns, or 7.5 to 25% by weight of carbon black with a particle size under 0.02 microns.

Instead of the finely divided carbon, or in addition thereto, the plastic can contain other electrically conductive materials such as metals or metal oxides. Electrically conductive polymers can also be used as the electrically conductive plastic.

The laminated electrode of the invention contains as the electrochemically active catalyst preferably the platinum-group metals ruthenium, iridium, palladium, platinum and/or rhodium, in metallic and/or oxide form.

Particularly effective catalysts have proven to be those composed of one or more platinum-group metals and/or platinum-group metal oxides and one or more of the base metals titanium, zirconium, hafnium, niobium, tantalum, manganese, iron, cobalt, nickel, tin, lead, antimony and bismuth in metallic or oxide form. Oxidic catalysts containing several metals can be mixtures of the individual oxides and/or mixed oxides.

The preferred supports are titanium sponge, especially with a particle size between 0.2 and 1.0 mm, and titanium oxides of the general formula $TiO_{2-x}$ *with* $0<x<1$, especially with a particle size between 0.03 and 0.5 mm. However, powdered titanium, zirconium, niobium or tantalum can also be used.

Catalytic particles consisting of the support particles and the catalyst applied to them, which are suitable for the laminated electrodes of the invention can be prepared by any of the methods known for this purpose (see for example European Patent Application No. 46 727). The impregnation of the support particles with solutions of thermally degradable compounds of the platinum-group metals and, in some cases, of the base metals, followed by heating and the galvanic coating of the support particles with the desired metals, fcllowed, if desired, by oxidation, has proven feasible.

In certain cases, for example for the improvement of mechanical stability, it has been found useful to provide the laminated electrode with a metal current distributor, such as expanded metal or metal mesh. The current distributor can be made, for example, of copper, iron, cobalt, nickel, alloys of these metals, aluminum, lead, titanium, zirconium, hafnium, niobium, tantalum, molybdenum or tungsten.

If a current distributor is provided, it is preferably first combined with the electrically conductive plastic under pressure at elevated temperature; then the catalytic particles preferably are applied to the plastic.

Electrically conductive plastic in the form of sheets or granules is firmly and permanently bonded to the current distributor by pressing the latter into it for ½ to 10 minutes at a temperature between 140° and 380° C. at a pressure of ½ to 2 metric tons per square centimeter. Then the catalytic particles are spread uniformly onto the plastic and pressed partially into the surface of the plastic at a temperature between 140° and 380° C. and a pressure of 0.1 to 2 metric tons per square centimeter, preferably for ½ minute to 10 minutes.

In accordance with the invention, a laminated electrode comprises an electrically conductive base body comprising electrically conductive plastic. The electrode also includes, partially embedded in the base body, catalytic particles comprising catalyst applied to supporting particles.

Also in accordance with the invention, a method of preparing a laminated electrode comprising an electrically conductive base body comprising electrically conductive plastic and, partially embedded in the base body, catalytic particles comprising catalyst applied to the supporting particles, comprises spreading the catalytic particles evenly on the electrically conductive plastic of the base body. The method also includes pressing the catalytic particles partially into the surface of the electrically conductive plastic of the base body at elevated temperature under pressure.

Also in accordance with the invention, a use of a laminated electrode comprising an electrically conductive base body comprising electrically conductive plastic and, partially embedded in the base body, catalytic particles comprising catalyst applied to the supporting particles comprises a use of the laminated electrode as an oxygen anode in metal recovery electrolysis in aqueous solutions.

For a better understanding of the invention, together with other and further objects thereof, reference is made to the following description, taken in connection with the accompanying drawing, and its scope will be pointed out in the appended claims.

Figure 2:
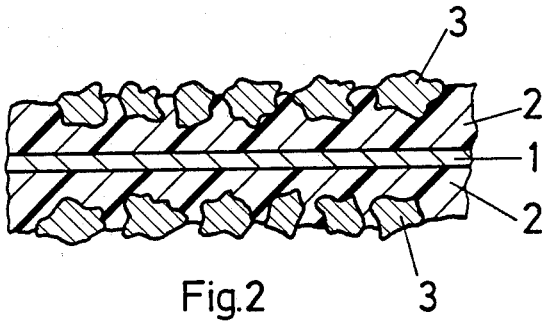
Figure 3:
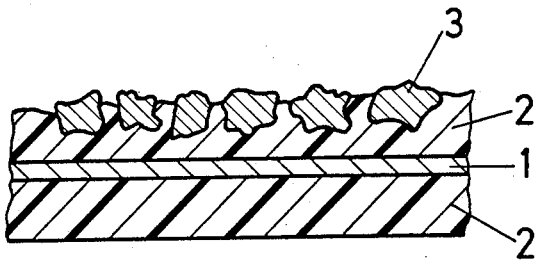

Referring now to the drawings:

FIGS. 1, 2 and 3 represent partial cross sections of thre embodiments of the laminated electrode of the invention.

In FIG. 1 the current distributor 1 is covered on one side by the electrically conductive plastic 2 with the catalytic particles 3 pressed partially into its surface. Since in this embodiment the current distributor comes in contact with the electrolyte, the current distributor here preferably consists of a chemically stable metal. In aqueous acid electrolytes, current distributors of expanded titanium metal have proven especially effective.

In FIG. 2, the current distributor 1 is covered on both sides by the electrically conductive plastic 2 with the catalytic particles 3 partially pressed into its surfaces. Since here the plastic protects the current distributor against the corrosive action of the electrolyte, the current distributor in this embodiment can comprise other, less expensive metals of better electrical conductivity, such as copper, for example.

FIG. 3 shows an embodiment similar to the one represented in FIG. 2. In this case, however, only one surface of the laminated electrode is covered by the catalytic particles 3.

The laminated electrode of the invention can be used as an oxygen anode in metal recovery electrolysis, in the electroplating art, in the electrochemical reduction of organic compounds, and in electrophoretic coating.

For further clarification, a description will be given in the examples that follow, of the production of laminated electrodes in accordance with the invention.

EXAMPLES

To determine the electrochemical properties and longterm performance (useful life) of the laminated electrodes described in Examples 1 to 5, the latter were used as oxygen anodes in an electrolysis cell containing sulfuric-acid electrolyte (150 g of sulfuric acid per liter; 50° C.) and a platinum cathode.

The half-cell anode potentials ("single-electrode potential"=SEP) were measured at various current densities against the saturated calomel electrode, the half-cell anode potentials were corrected for ohmic drop (IR) by the current interruption method ("current interruption single electrode potential"=CISEP), and the useful life until the failure of the anode, was determined at a current density of 0.3 kA/m$^2$ (Example 4) or 1 kA/m$^2$, characterized by a sharp increase in the cell voltage, as given in the Table.

EXAMPLE 1

Preparation of a laminated electrode with electrochemically active catalyst of ruthenium-titanium oxide (molar ratio of ruthenium to titanium=30:70).

Current distributor, diameter 33 mm: Titanium expanded metal, corrundum-blasted and etched with hydrochloric acid, mesh length 10 mm, mesh width 5.7 mm and strand thickness 1 mm, with a titanium wire conductor (diameter 2 mm)

Electrically conductive plastic: Disk (diameter 36 mm, thickness 6 mm) of Novolen KR 1682 made by BASF AG, Ludwigshafen, West Germany (polypropylene containing 80% of graphite by weight)

Support particles: Titanium sponge with a grain size of 0.4 to 0.85 mm, treated for 30 minutes with 10% oxalic acid at 90° C., washed with water and dried Impregnating solution:

0.1 g of $RuCl_3.xH_2O$ (38% Ru by weight)
0.3 g of tetrabutylorthotitanate
0.04 ml of 37% HCl solution
6 ml of isopropanol Preparation of the catalytic particles by impregnating (activating) the titanium sponge:

2 grams of the titanium sponge were mixed in a reagent glass with the impregnating solution. Then the supernatant liquid is decanted and the remaining moist powder is slowly dried in air. By a 30-minute heat treatment of the dried powder in a closed oven at 500° C. an active layer of ruthenium-titanium oxide was produced on the titanium sponge by thermal decomposition and oxidation.

The treatment with the impregnating solution and the heat treatment were repeated until a ruthenium content of 31.3 mg/g of titanium sponge was reached.

Pressing:

The current distributor was laid in a pressing die heated at 185° C. and the disk of Novolen KR 1682 was laid upon it. After allowing 10 minutes for temperature equalization the current distributor and disk were bonded together at a pressure of 0.1 t/cm$^2$ applied for 1 minute. Then 0.8 g of the activated titanium sponge (catalytic particles) was spread evenly over the disk and pressed into the surface of the disk at 180° C. at a pressure of 0.2 t/cm$^2$ for 1 minute The quantity of the catalytic particles corresponded to 800 grams per square meter of electrode surface area, with a ruthenium content of 25 grams.

EXAMPLE 2

Preparation of a laminated electrode containing an electrochemically active catalyst of ruthenium-titanium oxide (molar ratio of ruthenium to titanium=30:70).

Current distributor; diameter 33 mm: Expanded titanium metal, blasted with corundum and etched with hydrochloric acid (mesh length 10 mm, mesh width 5.7 mm, strand thickness 1 mm) with a conductor lead made of titanium wire (2 m diameter)

Electrically conductive plastic: Disk (diameter 36 mm, thickness 2.5 mm) of Lupolen 5261 Z made by BASF AG, Ludwigshafen, West Germany (a high-pressure polyethylene containing 7.5% by weight of carbon black)

Support particles: Titanium sponge with a grain size of 0.4 to 0.85 mm, etched for 30 minutes in 10% oxalic acid at 90° C., washed with water and dried Impregnating solution:

0.1 g of $RuCl_3.xH_2O$ (38% by weight Ru)
0.3 g of tetrabutyl orthotitanate
0.04 ml of 37% HCl solution
6 ml of isopropanol Preparation of the catalytic particles by impregnating (activating) the titanium sponge:

2 grams of the titanium sponge was mixed in a reagent glass with the impregnating solution. Then the supernatant liquid was decanted and the remaining moist powder was slowly dried in air. By a 30-minute heat treatment of the dried powder in a closed oven at 500° C. an active coating of ruthenium-titanium oxide was produced on the titanium sponge by thermal decomposition and oxidation of the ruthenium The treatment with the impregnating solution and the heat treatment were repeated until a ruthenium content of 31.3 milligrams per gram of titanium sponge was reached.

Pressing:

The current distributor was laid in a pressing die heated at 150° C. and the disk of Lupolen 5261 Z is laid on it. After waiting 10 minutes for temperature equalization, the current distributor and the disk were bonded together by pressing for one minute at 0.15 t/cm$^2$. Then 0.8 g of the activated titanium sponge (catalytic particles) was uniformly spread onto the disk and pressed into its surface at 140° C. at 0.2 t/cm$^2$ for one minute.

The quantity of the catalytic particles corresponded to 800 g/m$^2$ of electrode surface area, with a ruthenium content of 25 grams.

EXAMPLE 3

Preparation of a laminated electrode containing electrochemically active catalyst of ruthenium-titanium oxide (molar ratio of ruthenium to titanium=30:70).

Current distributor; diameter 33 mm: Expanded titanium metal, blasted with corundum and etched with hydrochloric acid, (mesh length 10 mm, mesh width 5.7 mm, strand thickness 1 mm), with a conductor of titanium wire (2 mm diameter).

Electrically conductive plastic: Disk (diameter 36 mm, thickness 4 mm) of Colcolor made by Degussa, Frankfurt (a polypropylene containing 25% by weight of carbon black).

Support particles: Titanium sponge with a grain size of 0.4 to 0.85 mm, treated for 30 minutes with 10% oxalic acid at 90° C., washed with water and dried.

Impregnating solution:

0.1 g $RuCl_3.xH_2O$ (38% Ru by weight)
0.3 g tetrabutyl orthotitanate
0.04 ml HCl, 37% solution
6 ml isopropanol.

Preparation of the catalytic particles by impregnating (activating) the titanium sponge:

2 grams of the titanium sponge were mixed with the impregnating solution in a reagent glass. Then the supernatant liquid was decanted and the remaining moist powder was slowly dried in air. By heat-treating the dried powder for 30 minutes in a closed oven at 500° C., an active coating of ruthenium-titanium oxide was produced on the titanium sponge by thermal decomposition and oxidation of the ruthenium chloride and titanate.

The treatment with the impregnating solution and the heat treatment were repeated until a ruthenium content of 31.3 milligrams per gram of titanium sponge was reached.

Pressing:

The current distributor was laid on a pressing die heated at 180° C. and the Colcolor disk was laid on it. After 10 minutes for temperature equalization the current distributor and disk were bonded together by pressing for one minute at 0.5 t/cm$^2$. Then 0.8 g of the activated titanium sponge (catalytic particles) was uniformly spread over the disk and pressed into the surface of the disk for one minute at a pressure of 0.5 t/cm$^2$.

The quantity of the catalytic particles corresponded to 800 g/m$^2$ of electrode surface area, with a ruthenium content of 25 g.

EXAMPLE 4

Preparation of a laminated electrode with electrochemically active catalyst of ruthenium-titanium oxide (molar ratio of ruthenium to titanium=30:70)

Current distributor; Diameter 33 mm: Expanded titanium metal, blasted with corundum and etched with hydrochloric acid, (mesh length 10 mm, mesh width 5.7, strand thickness 1 mm), with a conductor of titanium wire (2 mm diameter).

Electrically conductive plastic: Disk (diameter 36 mm, thickness 6 mm) of Novolen KR 1682 of BASF AG, Ludwigshafen, West Germany (a polypropylene containing 80% of graphite by weight)

Support particles: Titanium oxide of the formula $TiO_{2-x}$ ($0<x<1$) with a grain size of 0.037–0.1 mm Impregnating solution:

0.1 g $RuCl_3.xH_2O$ (38% Ru by weight)
0.3 g tetrabutyl orthotitanate
0.04 ml HCl, 37% solution
6 ml isopropanol.

Preparation of the catalytic particles by impregnating (activating) the titanium oxide:

2 grams of the titanium oxide were mixed with the impregnating solution in a reagent glass. Then the supernatant liquid was decanted and the remaining moist powder was slowly dried in air. By heat-treating the dried powder for 30 minutes in a closed oven at 500° C., an active coating of ruthenium-titanium oxide was produced on the titanium oxide by thermal decomposition and oxidation of the ruthenium chloride and titanate.

The treatment with the impregnating solution and the heat treatment were repeated until a ruthenium content of 31.3 milligrams per gram of titanium oxide was reached.

Pressing:

The current distributor was laid on a pressing die heated at 185° C. and the disk of Novolen KR 1682 was laid on it. After 10 minutes for temperature equalization, the current distributor and disk were bonded together by pressing for 1 minute at a pressure of 0.1 t/cm$^2$. Then 0.3 g of the activated titanium oxide (catalytic particles) were evenly spread on the disk and pressed into the surface of the disk at 185° C. and a pressure of 0.1 t/cm$^2$ for 1 minute.

The amount of catalytic particles corresponded to 300 g/m$^2$ of electrode surface area, with a ruthenium content of 15 grams.

EXAMPLE 5

Preparation of a laminated electrode with electrochemically active catalyst of ruthenium-titanium oxide (molar ratio of ruthenium to titanium=30:70).

Current distributor; diameter 33 mm: Expanded titanium metal, blasted with corundum and etched with hydrochloric acid, (mesh length 10 mm, mesh width 5.7 mm, strand thickness 1 mm), with a conductor of titanium wire (2 mm diameter).

Electrically conductive plastic: Granules of Hostaflon TF 4215 made by Farbwerke Hoechst AG, Frankfurt, West Germany (polytetrafluorethylene containing 25% graphite by weight).

Support particles: Titanium sponge of a grain size of 0.4 to 0.85 mm, treated for 30 minutes with 10% oxalic acid at 90° C., washed with water and dried.

Impregnating solution:

0.1 g RuCl $xH_2O$ (38% Ru by weight)
0.3 g tetrabutyl orthotitanate
0.04 ml HCl, 37% solution
6 ml isopropanol.

Preparation of the catalytic particles by impregnating (activating) the titanium sponge:

2 grams of the titanium sponge were mixed with the impregnating solution in a reagent glass. Then the supernatant liquid was decanted and the remaining moist powder was slowly dried in air. By heat-treating the dried powder for 30 minutes in a closed oven at 500° C., an active coating of ruthenium-titanium oxide was produced by thermal decomposition and oxidation of the ruthenium chloride and titanate.

The treatment with the impregnating solution and the heat treatment were repeated until a ruthenium content of 31.3 milligrams per gram of titanium sponge was reached.

Pressing:

2.5 grams of granules of Hostaflon TF 4215 were poured into a press die, evenly spread out, and formed into a disk (diameter 36 mm, thickness 2 mm) by pressing for 1 minute at room temperature at a pressure of 0.2 t/cm$^2$. The current distributor was then laid on the disk, covered with 2.5 grams of granules of Hostaflon TF 4215 and bonded on both sides to the Hostaflon TF 4215 by pressing for half a minute at room temperature, at a pressure of 0.05 t/cm$^2$. 0.8 g of the activated titanium sponge (catalytic particles) were pressed into each of the two plastic surfaces of the plastic/current distributor/plastic sandwich at room temperature and at a pressure of 0.8 t/cm$^2$ for 1 minute. By then sintering for one hour at 380° C., the finished electrode was obtained.

The quantity of the catalytic particles corresponded to 800 g/m$^2$ of electrode surface area, with a ruthenium content of 25 g.

EXAMPLE 6

Preparation of a laminated electrode with electrochemically active catalyst of platinum-iridium alloy.

Current distributor; diameter 33 mm: Expanded titanium metal, blasted with corundum and etched with hydrochloric acid, (mesh length 10 mm, mesh width 5.7 mm, strand thickness 1 mm), with a conductor of titanium wire (2 mm diameter).

Electrically conductive plastic: Disk (diameter 36 mm, thickness 2.5 mm) of Lupolen 5261 Z of BASF AG, Ludwigshafen, West Germany (a high-pressure polyethylene containing 7.5% of carbon black by weight)

Support particles: Titanium sponge of a grain size of 0.4 to 0.85 mm, treated for 30 minutes with 10% oxalic acid at 90° C., washed with water and dried.

Impregnating solution:

0.1 g $H_2[PtCl_6]$ 0.5 g $IrCl_3.xH_2O$ (41 percent by weight iridium)

10 ml isopropanol 10 ml linalool

Preparation of the catalytic particles by impregnating (activating) the titanium sponge:

2 grams of the titanium sponge were mixed with the impregnating solution in a reagent glass. Then the supernatant liquid was decanted and the remaining moist powder was slowly dried in air at 80° C. By heat-treating the dried powder for 30 minutes in a closed oven at 480° C. in a reducing atmosphere of ammonia/butane an active coating of 70 % by weight of Pt and 30 % by weight of Ir was produced on the titanium sponge.

The treatment with the impregnating solution and the heat treatment are repeated until a (Pt+Ir) content of 10 milligrams per gram of titanium sponge was reached.

Pressing:

The current distributor was laid on a pressing die heated at 185° C. and the disk of Novolen KR 1682 was laid on it. After 10 minutes for temperature equalization, the current distributor and disk were bonded together by pressing for 1 minute at a pressure of 0.1 t/cm$^2$. Then 0.8 g of the activated titanium sponge (catalytic particles) were uniformly spread on the disk and pressed into the surface of the disk at 180° C. with a pressure of 0.2 t/cm$^2$ for 1 minute.

The amount of catalytic particles corresponded to 800 g/m$^2$ of electrode surface area, with a content of platinum and iridium combined of 8 g.

EXAMPLE 7

Preparation of a laminated electrode with electrochemically active catalyst of ruthenium-manganese oxide (molar ratio of ruthenium to manganese=30:70).

Current distributor; diameter 33 mm: Expanded titanium metal, blasted with corundum and etched with hydrochloric acid, (mesh length 10 mm, mesh width 5.7 mm, strand thickness 1 mm), with a conductor of titanium wire (2 mm diameter).

Electrically conductive plastic: Disk (diameter 36 mm, thickness 6 mm) of Novolen KR 1682 of BASF AG, Ludwigshafen, West Germany (a polypropylene containing 80 percent by weight of graphite)

Support particles: titanium sponge of a grain size of 0.4 to 0.85 mm, treated for 30 minutes with 10% oxalic acid at 90° C., washed with water and dried.

Impregnating solution:

0.57 g of $RuCl_3.xH_2O$ (38 percent by weight of Ru) and 1.33 g $Mn(NO_3)_2.4H_2O$ are dissolved 4 ml of butanol. Butanol amounting to six times the weight of the solution is added to the latter.

Preparation of the catalytic particles by impregnating (activating) the titanium sponge:

2 grams of the titanium sponge, degreased with trichloroethane and dried, were mixed in a reagent glass with the impregnating solution. Then the supernatant liquid was decanted and the remaining moist powder was dried for about 1 hour at 100° C. By a 10-minute heat treatment at 200° C. followed by 12 minutes at 400° C. in a stream of air, an active layer of ruthenium-manganese oxide was produced on the titanium sponge.

The treatment with the impregnating solution and the heat treatment were repeated until a ruthenium content of 27.5 mg and a manganese content of 34.9 mg. per gram of titanium sponge were reached.

Pressing:

The current distributor was laid on a pressing die heated at 185° C. and the disk of Novolen KR 1682 was laid on it. After 10 minutes for temperature equalization, the current distributor and disk were bonded together by pressing for 1 minute at a pressure of 0.1 t/cm$^2$. Then 0.8 g of the activated titanium sponge (catalytic particles) was evenly distributed over the disk and pressed into the surface of the disk at 180° C. with a pressure of 0.2 t/cm$^2$ for 1 minute. The amount of catalytic particles corresponded to 800 g/m$^2$ of electrode surface area, with a ruthenium content of 22 grams and a manganese content of 27.9 g.

EXAMPLE 8

Preparation of a laminated electrode with electrochemically active catalyst of ruthenium-iridium oxide Current distributor; diameter 33 mm: Expanded copper metal, etched with nitric acid, (mesh length 21 mm, mesh width 9 mm, strand thickness 0.8 mm), with a conductor of titanium wire (2 mm diameter).

Electrically conductive plastic: Disk (diameter 36 mm, thickness 2.5 mm) of Lupolen 5261Z made by BASF AG, Ludwigshafen, West Germany (high-pressure polyethylene containing 7.5 percent by weight of carbon black)

Support particles: Titanium sponge of a grain size of 0.4 to 0.85 mm, treated for 30 minutes with 10% oxalic acid at 90° C., washed with water and dried.

Impregnating solution:

1.56 g IrClhd 3.$xH_2O$ (41% Ir by weight)

3.4 g $RuCl_3$. $xH_2O$ (38% Ru by weight)

1.25 ml HCl, 37% solution 100 ml isopropanol.

Preparation of the catalytic particles by impregnating (activating) the titanium sponge:

2 grams of the titanium sponge were mixed with the impregnating solution in a reagent glass. Then the supernatant liquid was decanted and the remaining moist powder was slowly dried for 2 hours at 120° C. By heat-treating the dried powder for 10 minutes in a closed oven at 250° C., an active coating of ruthenium-iridium oxide was produced by thermal decomposition and oxidation of iridium chloride and ruthenium chloride.

The treatment with the impregnating solution and the heat treatment were repeated until a ruthenium content of 20 milligrams per gram of titanium sponge and an iridium content of 10 mg per gram of titanium sponge was reached.

Pressing:

The current distributor was laid on a pressing die heated at 150° C. and the disk of Lupolen 5261 Z was laid on it. After 10 minutes for temperature equalization, the current distributor and disk were bonded together by pressing for 1 minute at a pressure of 0.15 t/cm$^2$. Then 0.8 g of the activated titanium sponge (catalytic particles) were evenly spread on the disk and pressed into the surface of the disk at 140 ° C. with a pressure of 0.2 t/cm$^2$ for 1 minute.

The amount of catalytic particles corresponded to 800 g/m$^2$ of electrode surface area, with an iridium content of 8 g and a ruthenium content of 16 grams.

EXAMPLE 9

Preparation of a laminated electrode with electrochemically active catalyst of ruthenium-palladium oxide Current distributor; diameter 33 mm: Expanded titanium metal, blasted with corundum and etched with hydrochloric acid, (mesh length 10 mm, mesh width 5.7 mm, strand thickness 1 mm), with a conductor of titanium wire (2 mm diameter).

Electrically conductive plastic: Disk (diameter 36 mm, thickness 4 mm) of Colcolor made by Degussa, Frankfurt, West Germany (a polypropylene containing 25 percent by weight of carbon black).

Support particles: Titanium sponge of a grain size of 0.4 to 0.85 mm, treated for 30 minutes with 10% oxalic acid at 90° C., washed with water and dried.

Impregnating solution:

0.54 g $RuCl_3.xH_2O$ (38 percent by weight Ru)
0.13 g $PdCl_3$ (both dissolved in 15 ml of butanol)
1.84 g tetrabutylorthotitanate Preparation of the catalytic particles by impregnating (activating) the titanium sponge:

2 grams of the titanium sponge were mixed with the impregnating solution in a reagent glass. Then the supernatant liquid was decanted and the remaining moist powder was slowly dried for 20 minutes at 140° C. By heat-treating the dried powder, first for 10 minutes at 250° C., then for 15 minutes at 450° C. in a closed oven, an active coating of ruthenium-palladium oxide was produced on the titanium sponge.

The treatment with the impregnating solution and the heat treatment were repeated until a ruthenium content of 18.8 milligrams per gram of titanium sponge and a palladium content of 6.9 milligrams per gram of titanium sponge was reached.

Pressing:

The current distributor was laid on a pressing die heated at 180° C. and the disk of Colcolor was laid on it. After 10 minutes for temperature equalization, the current distributor and disk were bonded together by pressing for 1 minute at a pressure of 0.5 t/cm$^2$. Then 0.8 g of the activated titanium sponge (catalytic articles) were evenly spread on the disk and pressed into the surface of the disk at 180° C. with a pressure of 0.5 t/cm$^2$ for 1 minute. The amount of catalytic particles corresponded to 800 g/m$^2$ of electrode surface area, with a ruthenium content of 15 grams and a palladium content of 5.5. g.

EXAMPLE 10

Current distributor; diameter 33 mm: Expanded titanium metal, blasted with corundum and etched with hydrochloric acid, (mesh length 10 mm, mesh width 5.7 mm, strand thickness 1 mm), with a conductor of titanium wire (2 mm diameter).

* Preparation of a laminated electrode with electrochemically active catalyst of ruthenium oxide Electrically conductive plastic: Disk (diameter 36 mm, thickness 2.5 mm) of Lupolen 5261 Z made by BASF AG, Ludwigshafen, West Germany (a high-pressure polyethylene containing 7.5 percent by weight of carbon black).

Support particles: Titanium sponge of a grain size of 0.4 to 0.85 mm, treated for 30 minutes with 10% oxalic acid at 90° C., washed with water and dried.

Impregnating solution:

1.67 g of $RuCl_3.xH_2O$ (38 percent by weight Ru)
6.7 ml of HCl
100 ml of isopropanol Preparation of the catalytic particles by impregnating (activating) the titanium sponge:

2 grams of the titanium sponge were mixed with the impregnating solution in a reagent glass. Then the supernatant liquid was decanted and the remaining moist powder was dried for 1 hour at 100° C. and then exposed for 15 minutes to a temperature of 250° C.

The treatment with the impregnating solution and the heat treatment were repeated until a ruthenium content of 15.6 milligrams per gram of titanium sponge was reached.

Then the ruthenium-treated titanium sponge was exposed in an oven for 10 minutes in each case to a temperature of 300° C., 430° C. and 400° C.

Pressing:

The current distributor was laid on a pressing die heated at 150° C. and the disk of Lupolen 5261 Z was laid on it. After 10 minutes for temperature equalization, the current distributor and disk were bonded together by pressing for 1 minute at a pressure of 0.15 t/cm$^2$. Then 0.8 g of the activated titanium sponge (catalytic particles) were evenly spread on the disk and pressed into the surface of the disk at 140° C. with a pressure of 0.2 t/cm$^2$ for 1 minute.

The amount of catalytic particles corresponded to 800 g/m$^2$ of electrode surface area, with a ruthenium content of 12.5 grams.

EXAMPLE 11

Preparation of a laminated electrode with electrochemically active catalyst of ruthenium-manganese-tin oxide Electrically conductive plastic: Disk (diameter 36 mm, thickness 6 mm) of Novolen KR 1682 made by BASF AG, Ludwigshafen, West Germany (a polypropylene containing 80% of graphite by weight)

Support particles: Titanium sponge of a grain size of 0.4 to 0.85 mm, treated for 30 minutes with 10% oxalic acid at 90° C., washed with water and dried.

Impregnating solution:

0.44 g $RuCl_3.xH_2O$ (38 percent by weight ruthenium)
0.09 g $SnCl_2.2H_2O$
0.52 g $Mn(NO_3)_2.4H_2O$
4 ml butanol Preparation of the catalytic particles by impregnating (activating) the titanium sponge:

2 grams of the titanium sponge were mixed with the impregnating solution in a reagent glass. Then the supernatant liquid was decanted and the remaining moist powder was dried for 15 minutes at 140° C. By heat-treating the dried powder first at 250° C., then at 420° C. for 10 minutes each, an active coating of ruthenium-manganese-tin oxide was produced by thermal decomposition and oxidation of ruthenium chloride, tin chloride and manganese nitrate.

The treatment with the impregnating solution and the heat treatment were repeated until a ruthenium content of 28.57 milligrams per gram of titanium sponge was reached.

Pressing:

The disk of Novolen KR 1682 was laid on a pressing die heated at 185° C. After 10 minutes for temperature equalization, 0.7 g of the activated titanium sponge (catalytic particles) were evenly spread on the disk and pressed into the surface of the disk at 180° C. with a pressure of 0.2 t/cm$^2$ for 1 minute.

The amount of catalytic particles corresponds to 700 g/m$^2$ of electrode surface area, with a ruthenium content of 20 grams, a manganese content of 13.7 g and a tin content of 5.8 g.

EXAMPLE 12

Preparation of a laminated electrode with electrochemically active catalyst of platinum Current distributor; diameter 33 mm: Expanded titanium metal, blasted with corundum and etched with hydrochloric acid, (mesh length 10 mm, mesh width 5.7 mm, strand thickness 1 mm), with a conductor of titanium wire (2 mm diameter).

Electrically conductive plastic; Disk (diameter 36 mm, thickness 4 mm) of Colcolor made by Degussa, Frankfurt, West Germany (a polypropylene containing 25 percent by weight of carbon black)

Support particles: Titanium sponge of a grain size of 0.4 to 0.85 mm, treated for 30 minutes with 10% oxalic acid at 90° C., washed with water and dried.

Solution for galvanic coating: 7 5 g KOH
10 g $K_2[Pt(OH)_6]$
500 ml water

Preparation of the catalytic particles by galvanic coating (activating) the titanium sponge:

The titanium sponge was placed on a steel plate and set together with the plate as cathode in the 75° C. solution for electroplating. Using an anode of platinated titanium, 100 mg of platinum per gram of titanium sponge was deposited over a period of 12 minutes at a cathodic current density of 11 mA/cm$^2$.

Pressing:

The current distributor was laid on a pressing die heated at 180° C. and the disk of Colcolor was laid on it. After 10 minutes for temperature equalization, the current distributor and disk were bonded together by pressing for 1 minute at a pressure of 0.5 t/cm$^2$. Then 0.2 g of the activated titanium sponge (catalytic particles) was evenly spread on the disk and pressed into the surface of the disk at 180° C. with a pressure of 0.5 t/cm$^2$ for 1 minute.

The amount of catalytic particles corresponded to 200 g/m$^2$ of electrode surface area, with a platinum content of 20 grams.

TABLE

| Example | Current distributor | Electrically conductive plastic | Support particle | Catalyst | Current Density [kA/m$^2$] | SEP [v] | CISEP [v] | Useful Life (Hours) |
|---|---|---|---|---|---|---|---|---|
| 1 | Titanium expanded metal diam. 33 mm | Novolen KR 1682 diam. 36 mm 6 mm thick | Titanium sponge 0.4–0.85 mm | RuTi oxide | 0.3<br>1 | 1.34<br>1.52 | 1.29<br>1.35 | 575 |
| 2 | Titanium expanded metal diam. 33 mm | Lupolen 5261 Z diam. 36 mm 2.5 mm thick | Titanium sponge 0.4–0.85 mm | RuTi oxide | 0.3<br>1 | 1.31<br>1.39 | 1.31<br>1.37 | 576 |
| 3 | Titanium expanded metal diam. 33 mm | Colcolor diam. 36 mm 4 mm thick | Titanium sponge 0.4–0.85 mm | RuTi oxide | 0.3<br>1 | 1.30<br>1.43 | 1.29<br>1.38 | 100 |
| 4 | Titanium expanded metal diam. 33 mm | Novolen KR 1682 diam. 36 mm 6 mm thick | Titanium oxide ($TiO_{2-x}$) 0.037–0.1 mm | RuTi oxide | 0.3 | 1.52 | 1.50 | 300 |
| 5 | Titanium expanded metal diam. 33 mm | Hostaflon TF 4215 2 × 2.5 g granules | Titanium sponge 0.4–0.85 | RuTi oxide | 0.3<br>1 | 1.30<br>1.39 | 1.29<br>1.34 | 280 |

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. In an electrochemical cell comprising an anode coupled to means for supplying a positive potential thereto and a cathode coupled to means for supplying a negative potential thereto, for use in an electrochemcial reaction of the type wherein the anode and the cathode project into an electrolyte, and electricity flows therebetween and through the electrolyte, the electrochemical reaction being of the type wherein oxygen is released at the anode, the release of oxygen normally requiring an overpotential to be applied wherein, the improvement comprises means for reducing the oxygen overpotential comprising an anode comprising an electrically conductive base body comprising electrically conductive plastic, which contains carbon black only in the range of 7.5–25% by weight with a particle size under 0.02 microns; and partially, embedded in said base body, catalytic particles comprising one or more catalysts applied to supporting particles.

2. The improvement in accordance with claim 1, in which said electrically conductive base body has at least a thickness of 2 mm.

3. A laminated electrode in accordance with claim 1, in which said electrically conductive base body contains finely divided carbon as electrically conductive material.

4. The improvement in accordance with claim 3, in which said electrically conductive base body comprises thermoplastic and finely divided carbon.

5. The improvement in accordance with claim 1, in which said catalyst comprises at least one of the group consisting of the platinum-group metals ruthenium, iridium, palladium, platinum and rhodium, and oxides thereof.

6. The improvement in accordance with claim 5, in which said catalyst comprises at least one of the group consisting of the platinum-group metals and oxides thereof and at least one of the group consisting of base metals and oxides thereof.

7. The improvement in accordance with claim 6, in which said base metal is at least one of the group consisting of titanium, zirconium, hafnium, niobium, tantalum, manganese, iron, cobalt, nickel, tin, lead, antimony and bismuth.

8. The improvment in accordance with claim 6, in which said catalyst consists of ruthenium-titanium oxide.

9. The improvement in accordance with claim 1, in which said supporting particles comprise at least one of the group consisting of titanium, zirconium, niobium and tantalum.

10. The improvement in accordance with claim 9, in which said supporting particles consist of titanium sponge.

11. The improvement in accordance with claim 10, in which the particle size of said titanium sponge is between 0.2 and 1.0 mm.

12. The improvement in accordance with claim 1, in which said supporting particles consist of titanium oxide of the general formula $TiO_{2-x}$ with $0<x<1$.

13. The improvement in accordance with claim 12, in which the size of said titanium oxide particles is between 0.03 and 0.5 mm.

14. The improvement in accordance with claim 1, which comprises a metal current distributor embedded in said electrically conductive base body.

15. The improvement in accordance with claim 14, in which said current distributor comprises a metal mesh.

16. The improvement in accordance with claim 14, in which said current distributor comprises expanded metal.

17. The improvement in accordance with claim 14, in which said current distributor consists of titanium.

18. The improvement in accordance with claim 14, in which said current distributor comprises at least one of the group consisting of copper and aluminum.

19. Method of using an oxygen-evolving laminated anode comprising an electrically conductive base body comprising electrically conductive plastic, which contains carbon black only in the range of 7.5–25% by weight with a particle size under 0.02 microns; and partially embedded in said base body, catalytic particles comprising one or more catalysts applied to supporting particles, the method of using the oxygen-evolving laminated anode comprising:

electrowinning metal from an aqueous acid electrolyte solution containing dissolved metal therein in an electrolysis cell containing a cathode, said anode and means to pass an electrolysis current through said cell between the anode and the cathode, by passing an electrolysis current through said cell to release oxygen at said anode and deposit dissolved metal from said solution on the cathode.

20. Method of using an oxygen-evolving laminated anode comprising an electrically conductive base body comprising electrically conductive plastic, which contains carbon black only in the range of 7.5–25% by weight with a particle size under 0.02 microns; and partially embedded in said base body, catalytic particles comprising one or more catalysts applied to supporting particles, the method of using the oxygen-evolving laminated anode comprising:

electroplating metal onto an electrically conductive substrate by providing said substrate and said anode in contact with an aqueous acid electrolytic metal plating bath and by passing an electric current through said plating bath in a direction to make said substrate a cathode and to release oxygen at said anode.

* * * * *

UNITED STATES PATENT AND TRADEMARK OFFICE

CERTIFICATE OF CORRECTION

PATENT NO. : 4,765,874

DATED : August 23, 1988

INVENTOR(S) : Christina Modes, et al.

It is certified that error appears in the above-identified patent and that said Letters Patent is hereby corrected as shown below:

Column 3, line 47 for "fcllowed" read -- followed --.

Column 4, line 35 for "thre" read -- three --.

Column 6, line 3 for "2 m" read -- 2 mm --.

Column 6, line 26 for "ruthenium" read -- ruthenium chloride and titanate. --

Column 11, line 57 for "EXAMPLE 10" read -- EXAMPLE 10* --.

Column 14, line 59 for "A laminated electrode" read

-- The improvement --.

Column 14, line 61 for "carbon" read -- carbon black --.

Column 14, line 65 for "carbon" read -- carbon black --.

Signed and Sealed this

Eighteenth Day of April, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,765,874

DATED : August 23, 1988

INVENTOR(S) : Christina Modes, et al.

It is certified that error appears in the above-identified patent and that said Letters Patent is hereby corrected as shown below:

On the Title Page, Item [54] and column 1, line 2,
For the title read -- LAMINATED ELECTRODE, A METHOD OF MAKING IT, AND THE USE THEREOF --.

Signed and Sealed this
Fifth Day of September, 1989

*Attest:*

*Attesting Officer*

DONALD J. QUIGG

*Commissioner of Patents and Trademarks*